US010352308B2

(12) United States Patent
Bergman et al.

(10) Patent No.: US 10,352,308 B2
(45) Date of Patent: Jul. 16, 2019

(54) RECIPROCATING COMPRESSOR WITH VAPOR INJECTION SYSTEM

(71) Applicant: EMERSON CLIMATE TECHNOLOGIES, INC., Sidney, OH (US)

(72) Inventors: Ernest R. Bergman, Yorkshire, OH (US); Frank S. Wallis, Sidney, OH (US); John P. Elson, Sidney, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 392 days.

(21) Appl. No.: 14/132,490

(22) Filed: Dec. 18, 2013

(65) Prior Publication Data

US 2014/0170003 A1 Jun. 19, 2014

Related U.S. Application Data

(60) Provisional application No. 61/738,741, filed on Dec. 18, 2012.

(51) Int. Cl.
*F04B 1/04* (2006.01)
*F04B 7/00* (2006.01)
(Continued)

(52) U.S. Cl.
CPC ..... *F04B 7/0057* (2013.01); *F04B 1/0413* (2013.01); *F04B 25/005* (2013.01);
(Continued)

(58) Field of Classification Search
CPC .... F04B 1/0413; F04B 7/0057; F04B 7/0061; F04B 7/0065; F16K 3/246; F16K 31/122
(Continued)

(56) References Cited

U.S. PATENT DOCUMENTS 793,864 A 7/1905 Harris
1,661,148 A 2/1928 Winkler
(Continued)

FOREIGN PATENT DOCUMENTS

CN 1432109 A 7/2003
CN 101238288 A 8/2008
(Continued)

OTHER PUBLICATIONS

Collins English Dictionary—Definition of Port.*
(Continued)

*Primary Examiner* — Devon C Kramer
*Assistant Examiner* — Christopher J Brunjes
(74) *Attorney, Agent, or Firm* — Harness, Dickey & Pierce, P.L.C.

(57) ABSTRACT

A compressor assembly is provided and may include a first compression cylinder, a first compression piston disposed within the first compression cylinder that compresses a vapor disposed within the first compression cylinder, and a crankshaft that cycles the first compression piston within the first compression cylinder. The compressor assembly may additionally include a first control piston moveable between a first state restricting passage of intermediate-pressure fluid into the first compression cylinder and a second state permitting passage of intermediate-pressure fluid into the first compression cylinder.

18 Claims, 9 Drawing Sheets

(51) Int. Cl.

| | |
|---|---|
| ***F04B 39/00*** | (2006.01) |
| ***F04B 39/12*** | (2006.01) |
| ***F04B 49/22*** | (2006.01) |
| ***F04B 53/10*** | (2006.01) |
| ***F04B 53/14*** | (2006.01) |
| ***F04B 25/00*** | (2006.01) |

(52) U.S. Cl.
CPC ..... *F04B 49/22* (2013.01); *F04B 53/10* (2013.01); *F04B 53/14* (2013.01)

(58) Field of Classification Search
USPC ..... 417/274–277, 470, 490–495, 499; 62/13, 62/512, 473, 513, 196.2, 498, 510, 296, 62/175, 278, 217, 505
See application file for complete search history.

(56) References Cited

U.S. PATENT DOCUMENTS 1,937,019 A * 11/1933 Hamill ..... F16N 13/10 112/256
1,969,076 A 8/1934 Hirsch
2,024,323 A 12/1935 Wyld
2,029,941 A * 2/1936 Pokorney ..... F02M 59/02 123/179.17
2,033,437 A 3/1936 McCune
2,274,224 A 2/1942 Vickers
2,510,887 A 6/1950 Hanson
2,772,831 A 12/1956 Cotter
3,548,868 A 12/1970 Mullaney
3,622,251 A * 11/1971 Allen ..... F04B 27/053 417/471
3,664,371 A 5/1972 Schneider
3,734,647 A 5/1973 Sparks
3,848,422 A 11/1974 Schibbye
3,951,574 A * 4/1976 Panuline ..... F04B 1/02 417/510
4,006,602 A * 2/1977 Fanberg ..... F04B 39/06 415/178
4,157,057 A 6/1979 Bailey
4,236,881 A * 12/1980 Pfleger ..... F04B 7/0053 417/502
4,303,376 A * 12/1981 Siekmann ..... A61M 5/14224 417/360
4,303,427 A 12/1981 Krieger
4,332,144 A 6/1982 Shaw
4,470,774 A 9/1984 Chambers
4,477,233 A 10/1984 Schaefer
4,567,733 A 2/1986 Mecozzi
4,594,858 A 6/1986 Shaw
4,620,836 A * 11/1986 Brandl ..... F02B 71/045 123/46 A
4,739,632 A * 4/1988 Fry ..... F25B 1/04 62/505
4,787,211 A 11/1988 Shaw
4,834,032 A * 5/1989 Brennan ..... F01B 7/14 123/51 BA
4,910,972 A 3/1990 Jaster
4,918,942 A 4/1990 Jaster
4,938,029 A 7/1990 Shaw
4,947,655 A 8/1990 Shaw
4,966,010 A 10/1990 Jaster et al.
4,974,427 A 12/1990 Diab
5,049,040 A * 9/1991 Diab ..... F04B 49/16 417/274
5,056,328 A 10/1991 Jaster et al.
5,056,329 A 10/1991 Wilkinson
5,062,274 A 11/1991 Shaw
5,081,963 A * 1/1992 Galbraith ..... F01L 1/34 123/188.5
5,094,085 A * 3/1992 Irino ..... F04C 18/3564 236/1 EA
5,095,712 A 3/1992 Narreau
5,106,278 A * 4/1992 Terwilliger ..... F04B 39/0011 417/547
5,203,857 A * 4/1993 Terwilliger ..... F04B 39/102 137/533.29
5,282,022 A 1/1994 Haruki et al.
5,284,426 A 2/1994 Strikis et al.
5,449,278 A 9/1995 Lin
5,511,389 A * 4/1996 Bush ..... F04C 29/042 417/97
5,547,347 A 8/1996 Sethna et al.
5,626,027 A 5/1997 Dormer et al.
5,647,731 A 7/1997 Onozawa
5,927,088 A 7/1999 Shaw
6,019,080 A 2/2000 LaGrone
6,089,830 A 7/2000 Harte et al.
6,120,266 A 9/2000 Teck
6,183,211 B1 2/2001 Wood
6,189,495 B1 * 2/2001 Tuckey ..... F02B 75/02 123/69 R
6,302,659 B1 * 10/2001 Parker ..... F04B 1/0404 417/273
6,318,891 B1 11/2001 Haffner et al.
6,318,977 B1 11/2001 Kopko
6,358,026 B1 3/2002 Palmore
6,450,788 B1 * 9/2002 Grabert ..... F04B 1/0448 123/450
6,514,058 B1 2/2003 Chou
6,558,135 B1 5/2003 Wood
6,568,198 B1 5/2003 Tadano et al.
6,616,428 B2 * 9/2003 Ebara ..... F04C 18/3564 418/11
6,638,029 B2 10/2003 Kharsa
6,651,458 B1 * 11/2003 Ebara ..... F04C 18/3564 62/510
6,695,596 B2 2/2004 Oh et al.
6,718,781 B2 4/2004 Freund et al.
6,732,542 B2 * 5/2004 Yamasaki ..... F01C 21/0809 418/11
6,748,754 B2 * 6/2004 Matsumoto ..... F04C 23/001 62/175
6,758,170 B1 * 7/2004 Walden ..... F02B 25/02 123/21
6,769,267 B2 * 8/2004 Ebara ..... F04C 23/001 181/403
6,792,910 B2 * 9/2004 Haman ..... F01M 11/02 123/196 R
6,802,701 B2 10/2004 Noh et al.
6,824,367 B2 * 11/2004 Matsumoto ..... F04C 23/008 418/1
6,835,052 B2 12/2004 Kim
6,892,545 B2 5/2005 Ishikawa et al.
6,905,318 B2 6/2005 Kouno et al.
6,907,746 B2 6/2005 Sato et al.
6,929,455 B2 8/2005 Dreiman et al.
6,931,866 B2 8/2005 Sato et al.
7,008,199 B2 * 3/2006 Matsumoto ..... F01C 21/0863 418/11
7,021,252 B2 4/2006 Warfel et al.
7,028,495 B2 4/2006 Ebara et al.
7,086,244 B2 8/2006 Yamasaki et al.
7,101,161 B2 9/2006 Matsumoto et al.
7,114,349 B2 10/2006 Lifson et al.
7,131,821 B2 11/2006 Matumoto et al.
7,147,442 B2 12/2006 Yeh
7,155,925 B2 1/2007 Yamasaki et al.
7,168,257 B2 1/2007 Matsumoto et al.
7,513,756 B2 * 4/2009 Aoki ..... F02M 47/027 417/470
7,647,790 B2 1/2010 Ignatiev et al.
8,157,538 B2 * 4/2012 Wallis ..... F04B 39/1066 251/63.5
8,197,240 B2 6/2012 Obara et al.
8,257,065 B2 * 9/2012 Divisi ..... F04B 53/162 137/539
RE44,636 E * 12/2013 Caillat ..... F04C 28/22 417/222.1

(56) References Cited

U.S. PATENT DOCUMENTS

| | | | | |
|---|---|---|---|---|
| 2002/0056366 | A1* | 5/2002 | Kleibrink | F04B 45/04 92/163 |
| 2003/0017067 | A1 | 1/2003 | Chou | |
| 2003/0059321 | A1* | 3/2003 | Ikegami | F04B 1/0439 417/470 |
| 2003/0082063 | A1 | 5/2003 | Noh et al. | |
| 2003/0145615 | A1* | 8/2003 | Sasaki | F04B 27/1804 62/228.3 |
| 2003/0165391 | A1 | 9/2003 | Kim | |
| 2004/0035377 | A1* | 2/2004 | Arao | F02B 33/04 123/73 C |
| 2004/0118147 | A1 | 6/2004 | Sato et al. | |
| 2004/0211216 | A1* | 10/2004 | Yamasaki | F04C 18/3564 62/498 |
| 2005/0044866 | A1 | 3/2005 | Shaw et al. | |
| 2005/0072173 | A1* | 4/2005 | Yamasaki | F04C 23/001 62/196.2 |
| 2005/0089413 | A1 | 4/2005 | Sato et al. | |
| 2005/0180869 | A1 | 8/2005 | Ursan et al. | |
| 2005/0191193 | A1 | 9/2005 | Chou | |
| 2005/0193967 | A1* | 9/2005 | Warfel | F02B 25/14 123/73 PP |
| 2006/0056981 | A1 | 3/2006 | Matumoto et al. | |
| 2006/0056982 | A1 | 3/2006 | Matumoto et al. | |
| 2006/0056983 | A1 | 3/2006 | Matumoto et al. | |
| 2006/0110273 | A1* | 5/2006 | Shaull | F02M 59/102 417/470 |
| 2007/0077157 | A1* | 4/2007 | Chou | F04B 35/01 417/437 |
| 2007/0234977 | A1* | 10/2007 | Thorpe | F02B 47/02 123/25 C |
| 2007/0243078 | A1* | 10/2007 | Schmidt | B60K 6/12 417/273 |
| 2008/0011261 | A1* | 1/2008 | Chrisman | F02B 33/12 123/193.2 |
| 2008/0080995 | A1 | 4/2008 | Inoue | |
| 2008/0156306 | A1* | 7/2008 | Cerreto | F02B 25/22 123/73 C |
| 2008/0170953 | A1* | 7/2008 | Lund | F04B 23/04 417/470 |
| 2009/0092511 | A1* | 4/2009 | Jiang | F04B 9/042 417/539 |
| 2009/0097997 | A1* | 4/2009 | Suzuki | F02M 59/462 417/470 |
| 2009/0246045 | A1* | 10/2009 | Kathmann | F04B 5/00 417/375 |
| 2009/0274569 | A1 | 11/2009 | Jansen | |
| 2010/0189581 | A1* | 7/2010 | Wallis | F04B 27/24 417/505 |
| 2011/0070113 | A1* | 3/2011 | Mohamed | F04B 39/1013 417/505 |
| 2013/0004339 | A1* | 1/2013 | Eisfelder | B60K 6/12 417/53 |
| 2014/0170006 | A1* | 6/2014 | Bergman | F04B 1/0413 417/559 |
| 2016/0245278 | A1 | 8/2016 | Bergman et al. | |

FOREIGN PATENT DOCUMENTS

| | | | | |
|---|---|---|---|---|
| CN | 101408176 | A | 4/2009 | |
| CN | 101568725 | A | 10/2009 | |
| CN | 101772643 | A | 7/2010 | |
| CN | 101896721 | A | 11/2010 | |
| CN | 101952595 | A | 1/2011 | |
| CN | 102997524 | A | 3/2013 | |
| DE | 102010033539 | A1 * | 11/2011 | B60K 6/12 |
| EP | 1413758 | A2 | 4/2004 | |
| JP | S578381 | A | 1/1982 | |
| JP | H04-255581 | A | 9/1992 | |
| JP | 2004239093 | A | 8/2004 | |
| WO | WO-2007128713 | A1 | 11/2007 | |
| WO | WO-2009021469 | A1 | 2/2009 | |
| WO | WO-2009031125 | A2 | 3/2009 | |
| WO | WO 2011121618 | A1 * | 10/2011 | F04B 39/08 |
| WO | WO-2011121618 | A1 | 10/2011 | |

OTHER PUBLICATIONS

Collins English Dictionary—"Port" (Year: 2017).*

International Search Report regarding Application No. PCT/US2013/076083, dated Apr. 8, 2014.

Written Opinion of the International Searching Authority regarding Application No. PCT/US2013/076083, dated Apr. 8, 2014.

Does the Voorhees-Principle Enhance the Efficiency of CO2 Refrigeration Systems?—K. Lambers, J. Suss, J. Kohler, 7th IIR Gustav Lorentzen Conference on Natural Working Fluids, Trondheim, Norway, May 28-31, 2006, 8 Pages.

Non-Final Office Action regarding U.S. Appl. No. 14/132,556, dated Nov. 5, 2014.

Final Office Action regarding U.S. Appl. No. 14/132,556, dated Mar. 5, 2015.

Advisory Action regarding U.S. Appl. No. 14/132,556, dated May 14, 2015.

Office Action regarding U.S. Appl. No. 14/132,556, dated Aug. 27, 2015.

Office Action regarding U.S. Appl. No. 14/132,556, dated Jan. 29, 2016.

"Isentropic and Volumetric Efficiencies for Compressors with Economizer Port," Klaus Jurgen Lambers, International Compressor Engineering Conference, Paper 1920 (2008). http://docs.lib.purdue.edu/icec/1920.

"Port Optimization of a Voorhees Modified CO2 Compressor Using Indicator Diagram Analysis", Klaus Lambers, International Compressor Engineering Conference, Paper 1733 (2006). http://docs.lib.purdue.edu/icec/1733.

European Patent Office Communication regarding Application No. 13864379.6 dated Aug. 1, 2016.

Office Action regarding Chinese Patent Application No. 201380070961.3, dated Jun. 2, 2016. Translation provided by Unitalen Attorneys at Law.

Search Report regarding European Patent Application No. 13864379.6, dated Dec. 19, 2016.

Klaus Jürgen Lambers. "Isentropic and Volumetric Efficiencies for Compressors with Economizer Port." International Compressor Engineering Conference, School of Mechanical Engineering. Purdue University. Jul. 14-17, 2008.

Election/Restriction Requirement regarding U.S. Appl. No. 15/142,915, dated Jun. 28, 2018.

Office Action regarding Chinese Patent Application No. 201710090053.0, dated Jul. 20, 2018. Translation provided by Unitalen Attorneys at Law.

Office Action regarding Chinese Patent Application No. 201710090389.7, dated Aug. 1, 2018. Translation provided by Unitalen Attorneys at Law.

Office Action regarding U.S. Appl. No. 15/142,915, dated Sep. 14, 2018.

* cited by examiner

RECIPROCATING COMPRESSOR WITH VAPOR INJECTION SYSTEM

CROSS-REFERENCE TO RELATED APPLICATIONS

This application claims the benefit of U.S. Provisional Application No. 61/738,741, filed on Dec. 18, 2012. The entire disclosure of the above application is incorporated herein by reference.

FIELD

The present disclosure relates to reciprocating compressors and more particularly to a reciprocating compressor incorporating a fluid-injection system.

BACKGROUND

This section provides background information related to the present disclosure which is not necessarily prior art.

Reciprocating compressors typically include a compressor body housing a drive motor and one or more piston-cylinder arrangements. In operation, the drive motor imparts a force on each piston to move the pistons within and relative to respective cylinders. In so doing, a pressure of working fluid disposed within the cylinders is increased.

Conventional reciprocating compressors may be used in refrigeration systems such as heating, ventilation, and air conditioning systems (HVAC) to circulate a refrigerant amongst the various components of the refrigeration system. For example, a reciprocating compressor may receive suction-pressure, gaseous refrigerant from an evaporator and may elevate the pressure from suction pressure to discharge pressure. The discharge-pressure, gaseous refrigerant may exit the compressor and encounter a condenser to allow the refrigerant to change phase from a gas to a liquid. The liquid refrigerant may then be expanded via an expansion valve prior to returning to the evaporator where the cycle begins anew.

In the foregoing refrigeration system, the compressor requires electricity in order to drive the motor and compress refrigerant within the system from suction pressure to discharge pressure. As such, the amount of energy consumed by the compressor directly impacts the costs associated with operating the refrigeration system. Conventional compressors are therefore typically controlled to minimize energy consumption while still providing sufficient discharge-pressure refrigerant to the system to satisfy a cooling and/or heating demand.

Compressor capacity and, thus, the energy consumed by a reciprocating compressor during operation may be controlled by employing so-called "blocked-suction modulation." Controlling compressor capacity via blocked-suction modulation typically involves starving the compressor of suction-pressure, gaseous refrigerant at times when a low volume of discharge-pressure refrigerant is required by the refrigeration system and allowing suction-pressure, gaseous refrigerant to freely flow into the compressor at times when a high volume of discharge-pressure refrigerant is required by the refrigeration system. Generally speaking, a low volume of discharge-pressure refrigerant is required at times when the load experienced by the refrigeration system is reduced and a high volume of discharge-pressure refrigerant is required at times when the load experienced by the refrigeration system is increased.

Controlling a reciprocating compressor via blocked-suction modulation reduces the energy consumption of the compressor during operation by reducing the load on the compressor to approximately only that which is required to meet system demand. However, conventional reciprocating compressors do not typically include a fluid-injection system such as a vapor-injection system or a liquid-injection system. As a result, conventional reciprocating compressor capacity is typically limited to the gains experienced via implementation of blocked-suction modulation and/or via a variable-speed drive.

SUMMARY

This section provides a general summary of the disclosure, and is not a comprehensive disclosure of its full scope or all of its features.

A compressor assembly is provided and may include a first compression cylinder, a first compression piston disposed within the first compression cylinder that compresses a vapor disposed within the first compression cylinder, and a crankshaft that cycles the first compression piston within the first compression cylinder. The compressor assembly may additionally include a first control piston moveable between a first state restricting passage of intermediate-pressure fluid into the first compression cylinder and a second state permitting passage of intermediate-pressure fluid into the first compression cylinder.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
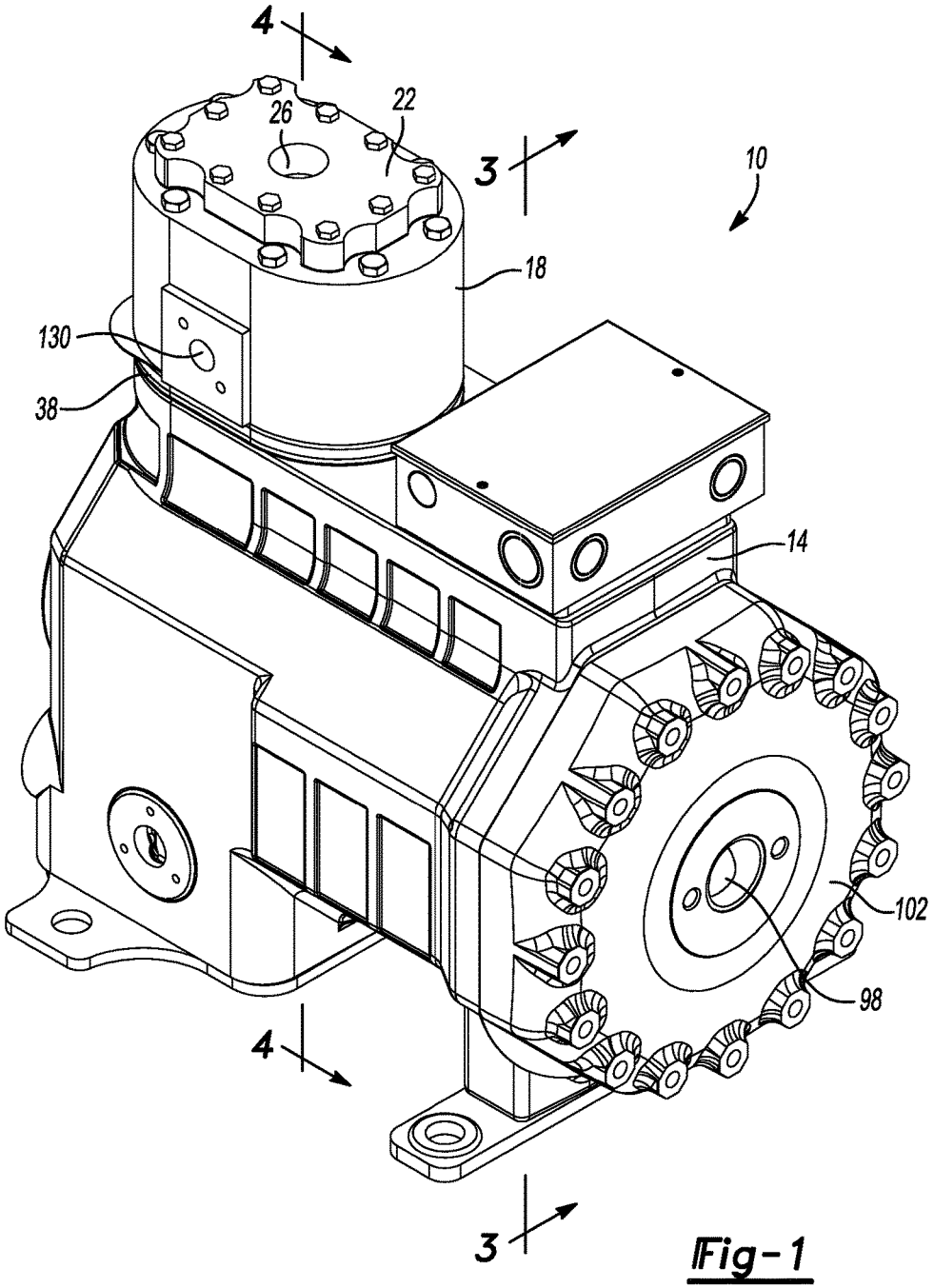
FIG. 1 is a perspective view of a compressor according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 2:
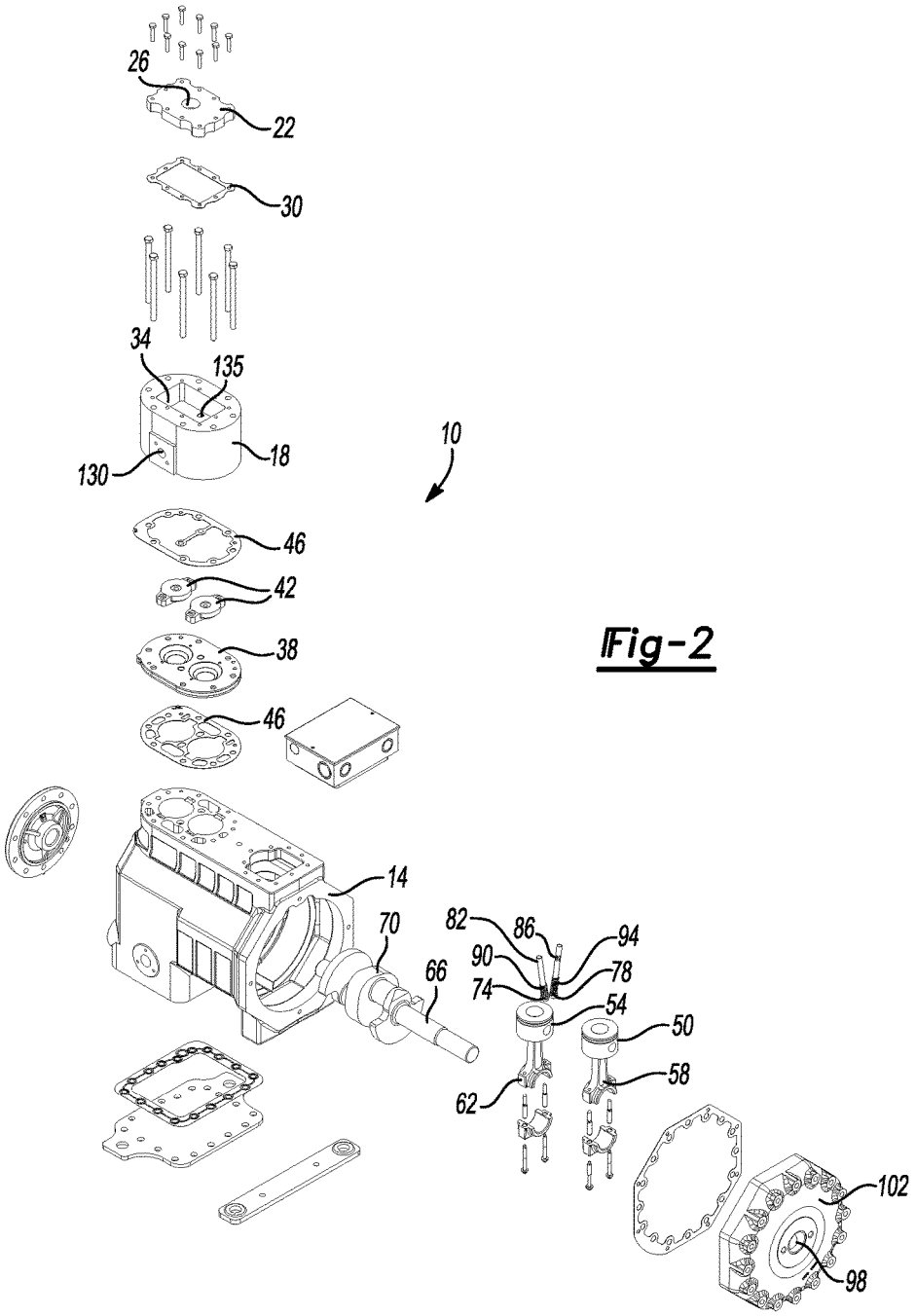
FIG. 2 is an exploded view of the compressor of FIG. 1.
Figure 3:
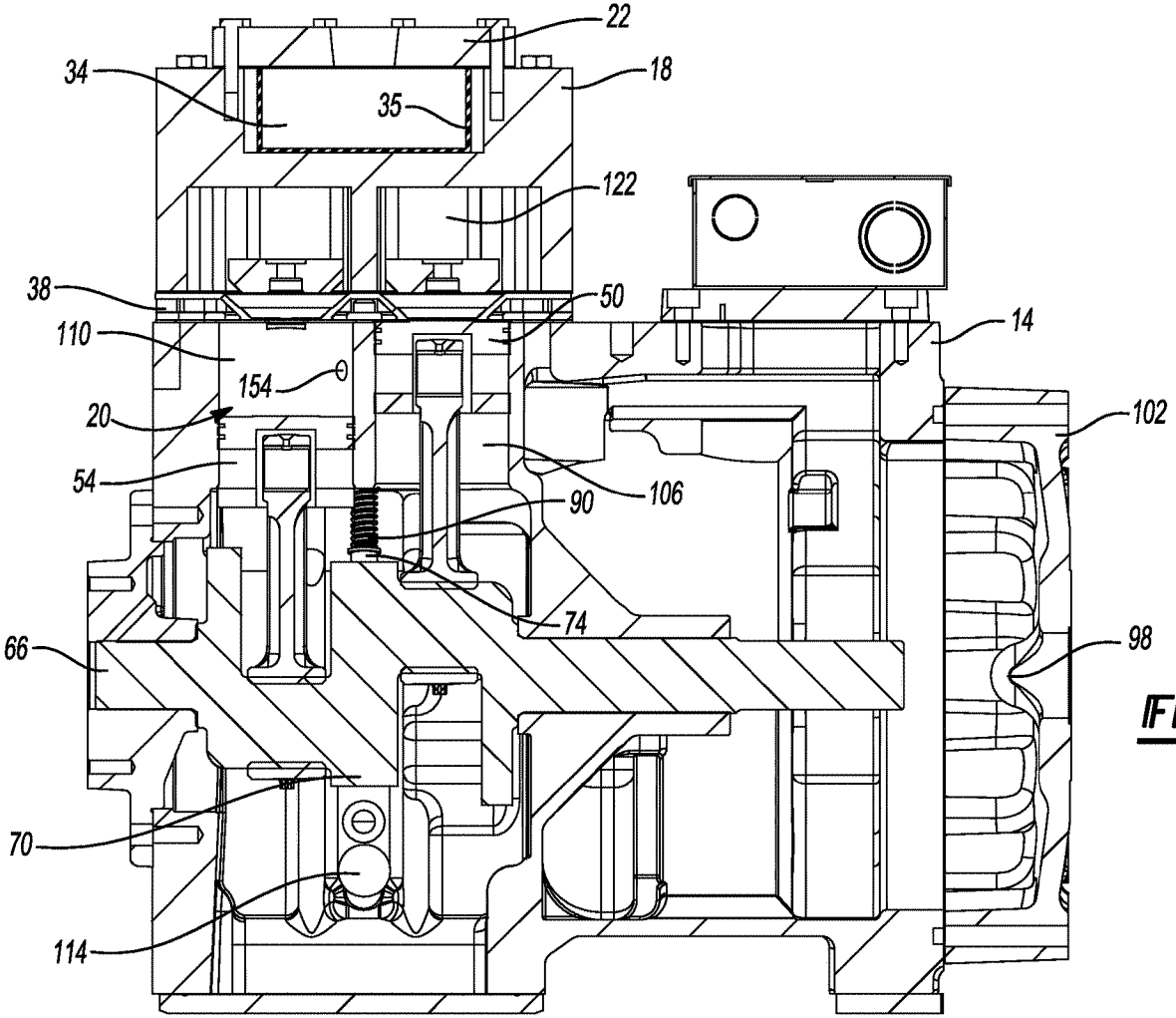
FIG. 3 is a cross-sectional view of the compressor of FIG. 1 taken along line 3-3.

With initial reference to FIGS. 1-3, a reciprocating compressor assembly 10 is provided and may include a compressor housing 14 and a cylinder head 18. The compressor housing 14 and cylinder head 18 may contain a compression mechanism 20 that selectively compresses a fluid from a suction pressure to a discharge pressure to cause the fluid to circulate amongst the various components of a refrigeration system.

The cylinder head 18 may include a top plate 22 having an inlet port 26, a top plate gasket 30, and a vapor-storage plenum 34. The cylinder head 18 may be incorporated into the compressor housing 14 by a valve plate 38 that includes valve retainers 42 and one or more gaskets 46 that serve to seal the cylinder head 18 and compressor housing 14 from outside contaminants.

The compression mechanism 20 may include first and second pistons 50, 54 that are located within the compressor housing 14 and are reciprocally movable in linear directions by respective connecting rods 58, 62. The connecting rods 58, 62 are disposed between the respective pistons 50, 54 and a crankshaft 66 to allow a rotational force applied to the crankshaft 66 to be transmitted to the pistons 50, 54. While the compressor assembly 10 is shown and described as including two pistons 50, 54, the compressor assembly 10 could include fewer or more pistons.

Figure 4:
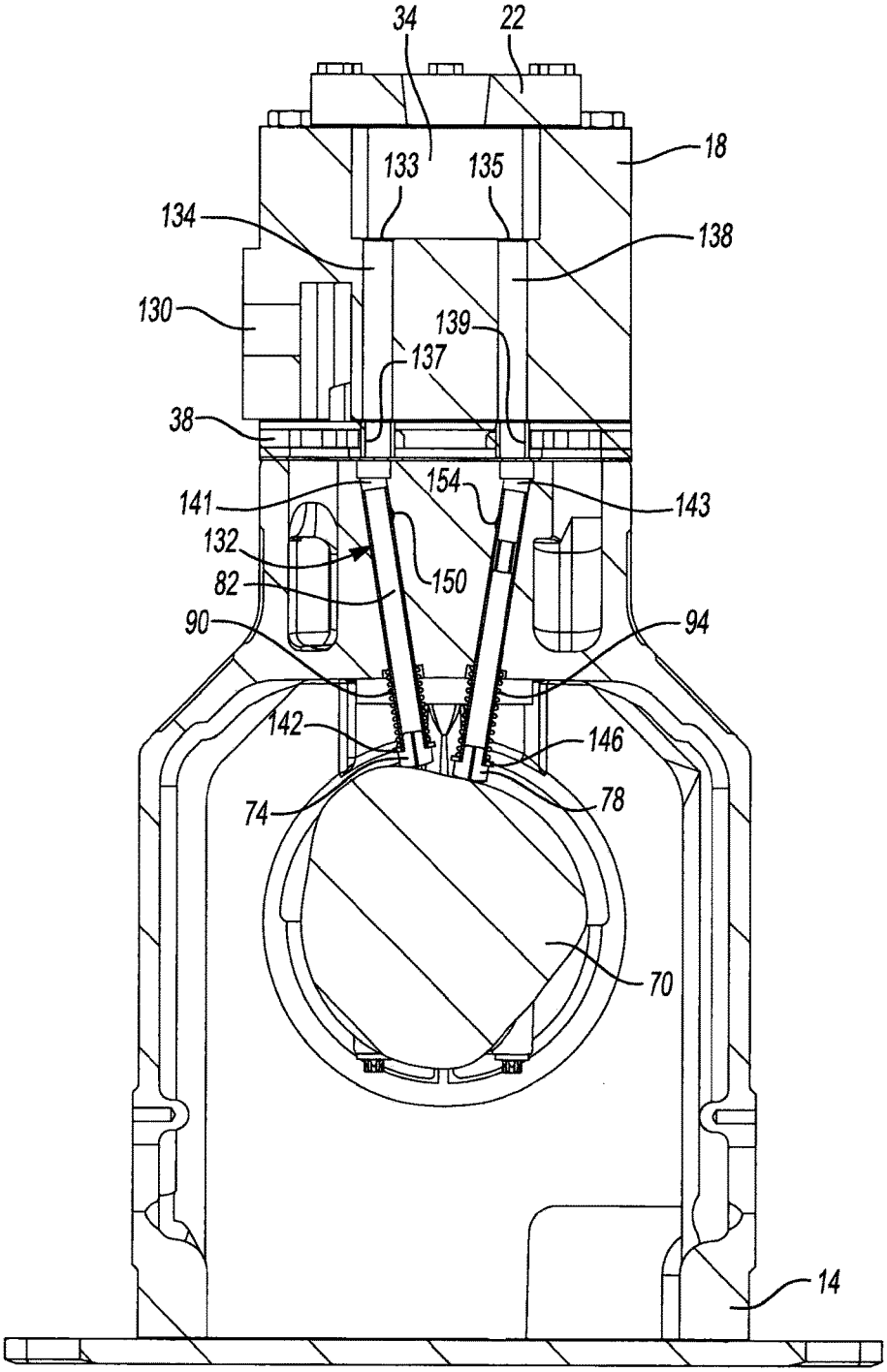
FIG. 4 is a cross-sectional view of the compressor of FIG. 1 taken along line 4-4.

The crankshaft 66 includes a cam profile 70 for controlling first and second followers 74, 78. The first and second followers 74, 78 are fixed for movement with respective cam pistons (or control pistons) 82, 86 and are biased into engagement with the cam profile 70 of the crankshaft 66 via a respective spring 90, 94 (FIG. 4).

In operation, gaseous fluid (such as a refrigerant) is compressed in the compressor assembly 10 from a suction pressure to a discharge pressure. The refrigerant initially passes through a suction inlet port 98 formed in an end cap 102 of the compressor assembly 10 and enters the housing 14 in a low-pressure, gaseous form (i.e., at suction pressure). As described, the compressor assembly 10 is a so-called "low-side" compressor, as the suction-pressure vapor that enters the compressor housing 14 is permitted to fill an inner volume of the housing 14.

Once in the housing 14, the refrigerant may be drawn into first and second cylinders 106, 110 for compression. Specifically, when the first and second pistons 50, 54 are cycled within the respective cylinders 106, 110—due to rotation of the crankshaft 66 relative to the housing 14—the refrigerant is drawn from the interior volume of the housing 14 and into the first and second cylinders 106, 110. The refrigerant is then compressed within each cylinder 106, 110 from suction pressure to discharge pressure as the pistons 50, 54 are moved within and relative to each cylinder 106, 110. In other examples, there may be a single cylinder 106 or there may be any other number of cylinders in the housing 14 to accommodate the number of pistons 50, 54.

Refrigerant enters the first and second cylinders 106, 110 during a suction stroke of each piston 50, 54 when the piston 50, 54 is moving from a top dead center (TDC) position to a bottom dead center (BDC) position. When the piston 50, 54 is at the TDC position, the crankshaft 66 must rotate approximately one-hundred and eighty degrees (180°) to move the particular piston 50, 54 into the BDC position, thereby causing the piston 50, 54 to move from a location proximate to a top portion of the particular cylinder 106, 110 to a bottom portion of the cylinder 106, 110. While the pistons 50, 54 are moved to the BDC position from the TDC position, the particular cylinder 106, 110 is placed under a vacuum, which causes suction-pressure vapor to be drawn into the cylinder 106, 110.

The first and second pistons 50, 54 move linearly in alternating directions as the crankshaft 66 is driven by an electric motor (not shown). As the crankshaft 66 rotates, the piston 50, 54 is driven in an upward direction, compressing refrigerant disposed within the cylinder 106, 110. When the pistons 50, 54 travel to the TDC position, the effective volume of the cylinder 106, 110 is reduced, thereby compressing the refrigerant disposed within the cylinder 106, 110. The compressed refrigerant remains in the gaseous state but is elevated from suction pressure to discharge pressure. At this point, the refrigerant may exit the cylinders 106, 110 and enter a discharge chamber 122.

Following compression, the piston 50, 54 returns to BDC and refrigerant is once again drawn into the cylinder 106, 110. While the first and second pistons 50, 54 are concurrently driven by the crankshaft 66, the first and second pistons 50, 54 are out-of-phase with one another. Namely, when one of the pistons 50, 54 is in the TDC position, the other of the pistons 50, 54 is in the BDC position. Further, when one of the pistons 50, 54 is moving from the BDC position to the TDC position, the other of the pistons 50, 54 is moving from the TDC position to the BDC position. Accordingly, for a compressor assembly 10 having a pair of pistons 50, 54, one of the pistons 50, 54 is drawing gaseous refrigerant into one of the cylinders 106, 110 during operation of the compressor assembly 10 while the other of the pistons 50, 54 is compressing refrigerant in the other of the cylinders 106, 110.

The refrigerant may be expelled from the cylinder head 18 through a discharge port 130 in the cylinder head 18 once the refrigerant reaches discharge pressure. The discharge-pressure refrigerant remains in the vapor state and may be communicated to a heat exchanger of an external refrigeration system (neither shown). For example, the discharge-pressure refrigerant may be communicated to a condenser (not shown) of a refrigeration system to allow the refrigerant to release heat and change phase from a vapor to a liquid, thereby providing a heating or cooling effect to a conditioned space.

With particular reference to FIGS. 1-4, a fluid-injection system such as an economized vapor-injection system 132 is shown as being implemented in the compressor assembly 10 to increase compressor performance. The vapor-injection system 132 may selectively inject intermediate-pressure vapor/gas into the compressor assembly 10 to reduce the work required by the compressor assembly 10 to elevate a pressure of the vapor to discharge pressure. As a result, the energy consumed by the compressor assembly 10 in generating discharge-pressure vapor can be reduced, thereby resulting in an increase in both compressor capacity and efficiency.

The vapor-injection system 132 may receive intermediate-pressure vapor from an external heat exchanger such as a flash tank or economizer heat exchanger (neither shown) and may selectively supply the intermediate-pressure vapor to the compressor housing 14 via the cylinder head 18 and the inlet port 26 formed in the top plate 22. The intermediate-pressure vapor may be stored in the vapor-storage plenum 34 until the intermediate-pressure vapor is needed during the compression cycle. Optionally, the vapor-storage plenum 34 may include an insulating layer 35 such as a polymeric or other insulating coating. The insulating layer 35 restricts heat associated with the discharge-pressure vapor from reaching the vapor-storage plenum 34.

The cylinder head 18 and the compressor housing 14 may cooperate to provide a fluid path extending between the vapor-storage plenum 34 and the cylinders 106, 110. The fluid path may include a pair of ports 133, 135 that are formed in the cylinder head 18 and are in communication with fluid passageways 134, 138 formed through the cylinder head 18. The passageways 134, 138 may extend through the cylinder head 18 such that each port 133, 135 is in fluid communication with ports 137, 139 formed in the valve plate 38 (FIG. 4) via the passageways 134, 138.

As shown in the FIG. 4, the ports 137, 139 are disposed in close proximity to the compressor housing 14 to allow intermediate-pressure vapor disposed within each passageway 134, 138 to freely flow from the passageways 134, 138 and into the compressor housing 14 via the ports 137, 139. The intermediate-pressure vapor flows into the ports 137, 139 due to the pressure difference between the pressure of the compressor housing 14 (at suction pressure) and the pressure of the intermediate-pressure vapor.

The intermediate-pressure vapor is permitted to freely enter a pair of fluid passageways 141, 143 (FIG. 4) formed in the compressor housing 14 but is restricted from freely flowing into the cylinders 106, 110 by the pistons 82, 86. Accordingly, the pistons 82, 86 control the flow of intermediate-pressure vapor from the passageways 134, 138 and into the first and second cylinders 106, 110.

In operation, the crankshaft 66 rotates the cam profile 70, as the cam profile 70 is fixed for rotation with the crankshaft 66. The cam profile 70 is shaped such that as the cam profile 70 rotates, the first and second followers 74, 78 move linearly, alternating in direction. The first and second followers 74, 78 and the first and second pistons 82, 86 are offset to utilize a single cam profile 70 to operate the opening and closing of both pistons 82, 86. The first and second springs 90, 94 are separated from the first and second followers 74, 78 by respective washers 142, 146 and keep constant contact between the first and second followers 74, 78 and the cam profile 70 by biasing the followers 74, 78 into engagement with the cam profile 70.

The first and second pistons 82, 86 may each include a substantially cylindrical shape with each piston 82, 86 being substantially hollow from a first end proximate to ports 137, 139 to a second end proximate to the first and second followers 74, 78. While the pistons 82, 86 are described as being substantially hollow, the followers 74, 78 may be received within respective second ends of the pistons 82, 86 to partially close each piston 82, 86 at the second end (FIG. 4).

In one configuration, the pistons 82, 86 are disposed within the passageways 141, 143 and are permitted to translate within each passageway 141, 143. Movement of the pistons 82, 86 relative to and within the passageways 141, 143 is accomplished by movement of the first and second followers 74, 78 relative to the compressor housing 14. Specifically, engagement between the first and second followers 74, 78 and the cam profile 70—due to the force exerted on each follower 74, 78 by the biasing members 90, 94—causes the followers 74, 78 to move relative to and within each passageway 131, 143 as the crankshaft 66 rotates.

While the biasing member 90, 94 urge each follower 74, 78 into engagement with the cam profile 70, the followers 74, 78 may also be biased into engagement with the cam profile 70 by the intermediate-pressure vapor disposed within the vapor-storage plenum 34. Specifically, intermediate-pressure vapor may be received within each piston 82, 86 from the vapor-storage plenum 34 at the first end of each piston 82, 86 and may exert a force directly on the followers 74, 78. Specifically, the intermediate-pressure vapor is permitted to flow into the substantially hollow portion of each piston 82, 86 due to the pressure differential between the vapor-storage plenum 34 (intermediate pressure) and the compressor housing 14 (suction pressure). Once the intermediate-pressure vapor enters and substantially fills each piston 82, 86, the intermediate-pressure vapor encounters each follower 74, 78 proximate to the second end of each piston 82, 86 and urges each follower 74, 78 toward the cam profile 70.

Permitting intermediate-pressure vapor to substantially fill each piston 82, 86 likewise allows any lubricant disposed within the intermediate-pressure vapor to likewise enter the pistons 82, 86. Such lubricant may be drained from the pistons 82, 86 via passageways 83, 87 (FIGS. 5 and 6) respectively formed in the followers 74, 78. Draining lubricant from the pistons 82, 86 prevents each piston 82, 86 from being filled with lubricant and further provides the added benefit of providing lubricant to point-of-contact between each follower 74, 78 and the cam profile 70.

As best shown in FIG. 4, the cam profile 70 includes an irregular shape that causes the rise and fall of the followers 74, 78 and, thus, the pistons 82, 86 within the passageways 141, 143. Because the cam profile 70 includes an irregular shape, the pistons 82, 86 will either move closer to or farther away from the valve plate 38 depending on the location of the followers 74, 78 along the cam profile 70.

Figure 6:
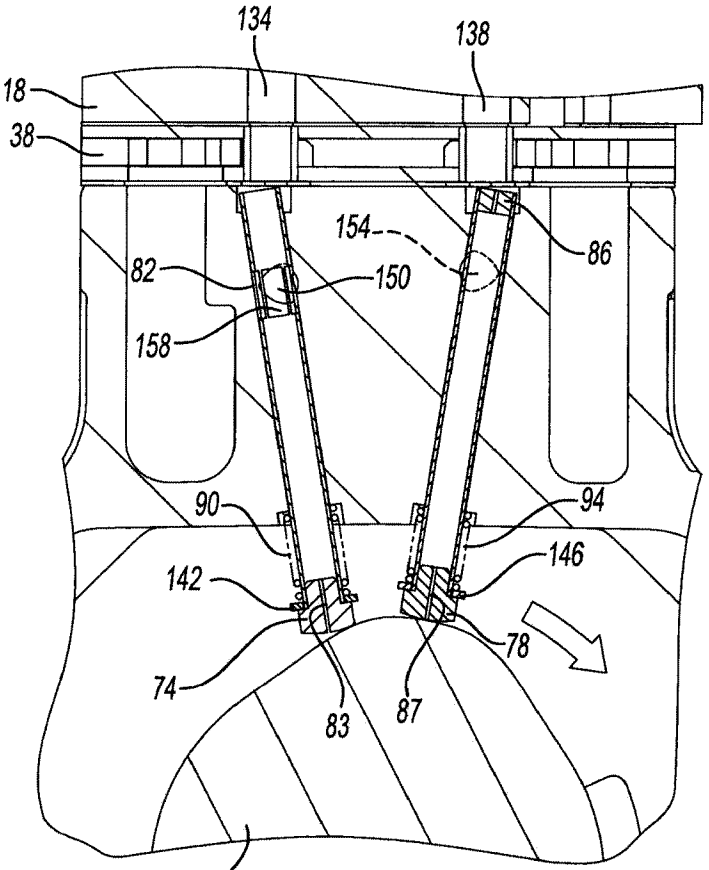
FIG. 6 is a partial cross-sectional view of the compressor of FIG. taken along line 4-4 and showing one of a pair of fluid-injection ports in an open state.
Figure 5:
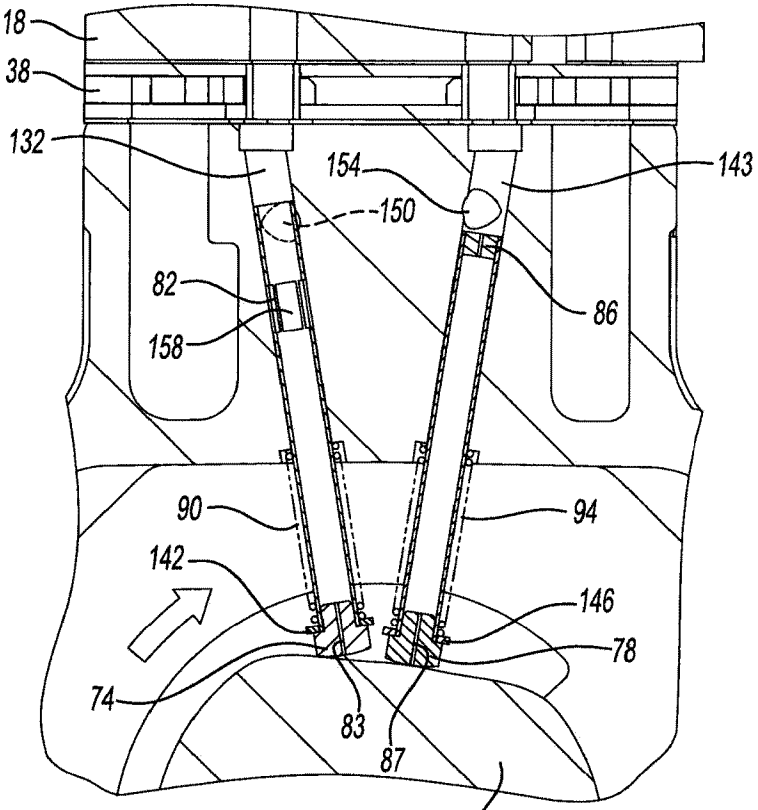
FIG. 5 is a partial cross-sectional view of the compressor of FIG. 1 taken along line 4-4 and showing one of a pair of fluid-injection ports in an open state.
Figure 7:
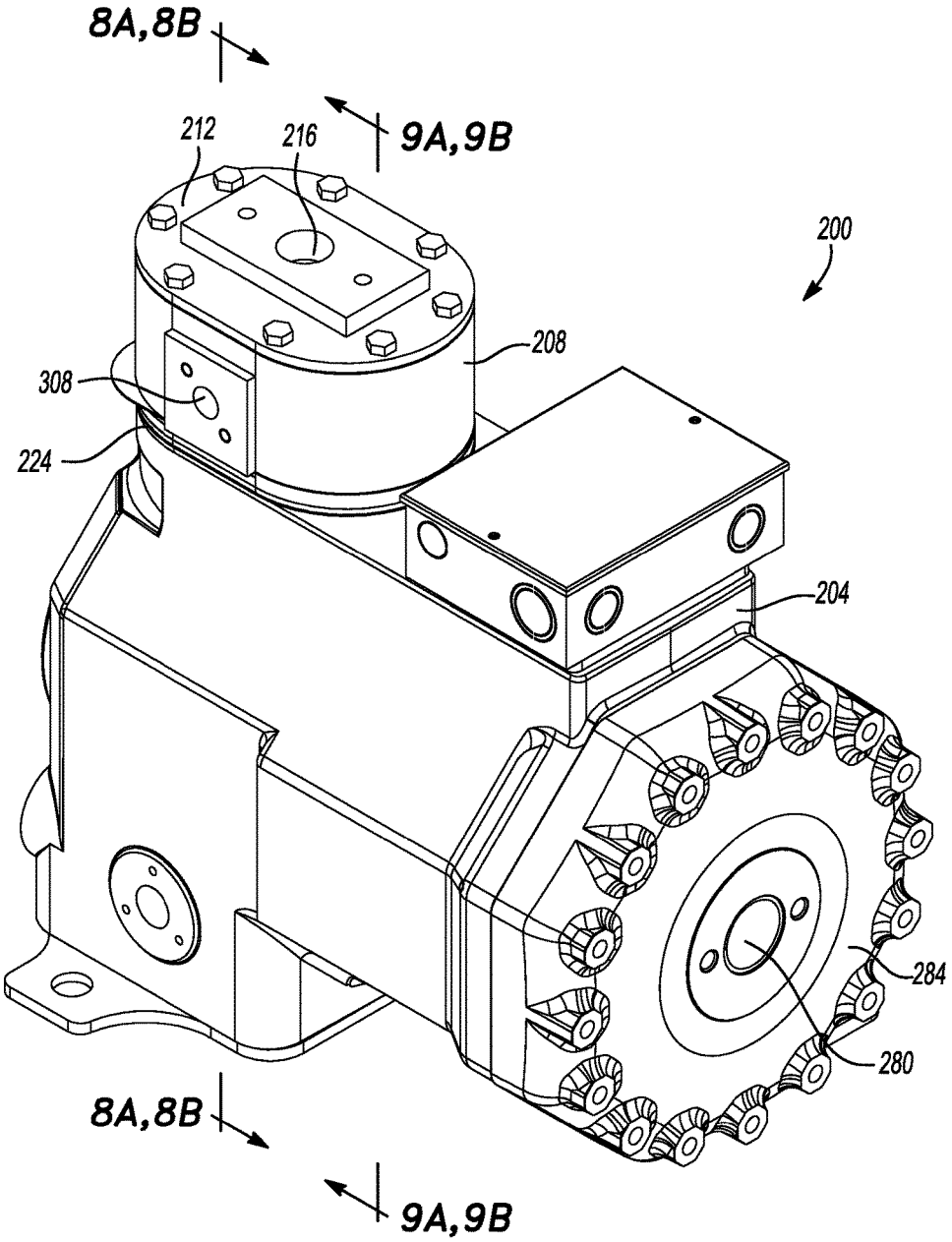
FIG. 7 is a perspective view of a compressor in accordance with the principles of the present disclosure.
Figure 8B:
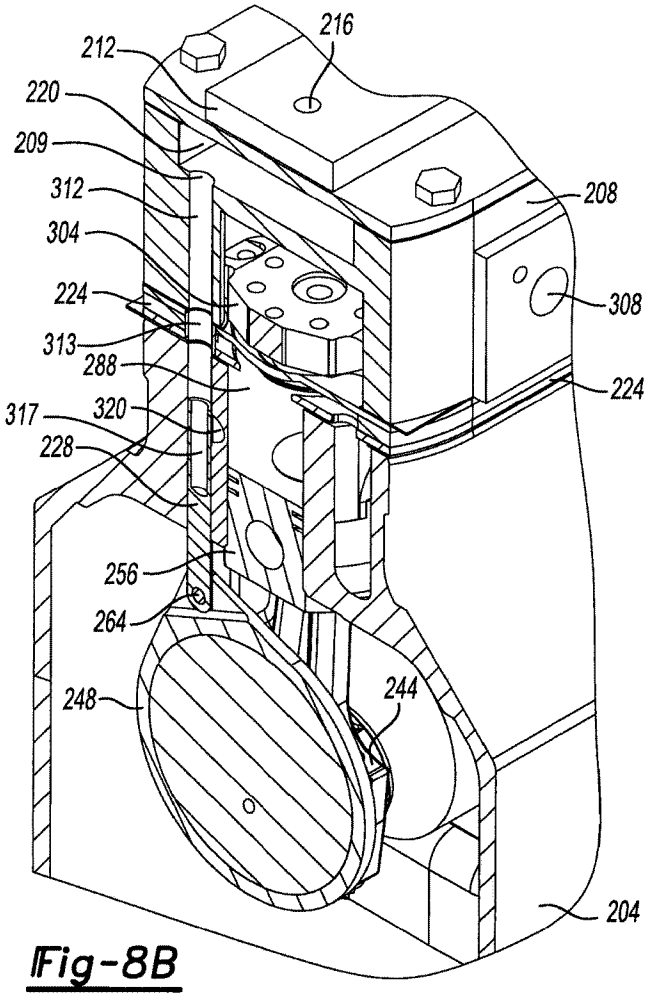
FIG. 8B is a perspective, cross-sectional view of the compressor of FIG. 7 taken along line 8B-8B and showing one of a pair of fluid-injection ports in a closed state.
Figure 8A:
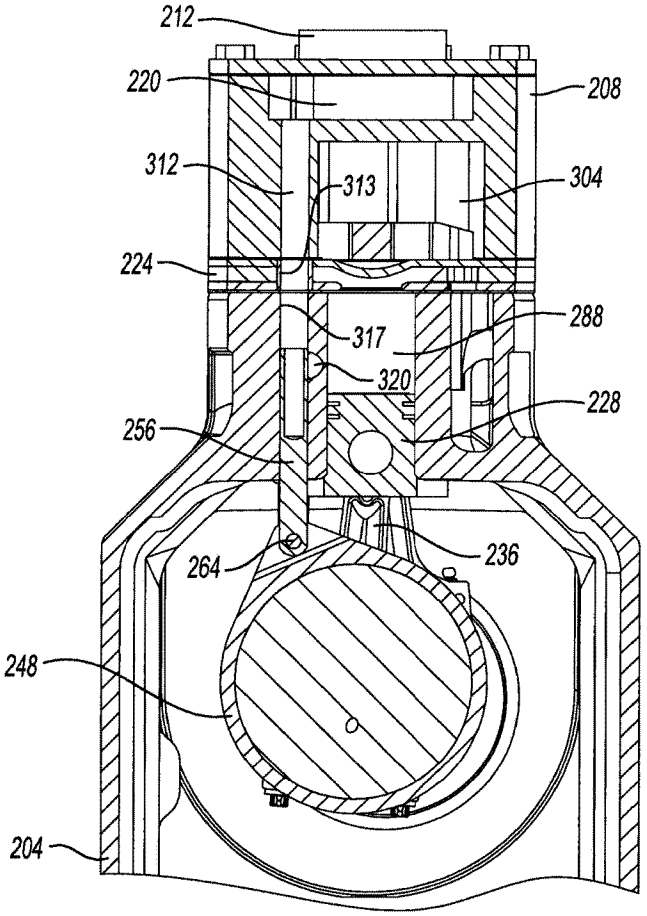
FIG. 8A is cross-sectional view of the compressor of FIG. 7 taken along line 8A-8A and showing one of a pair of fluid-injection ports in a closed state.
Figure 9B:
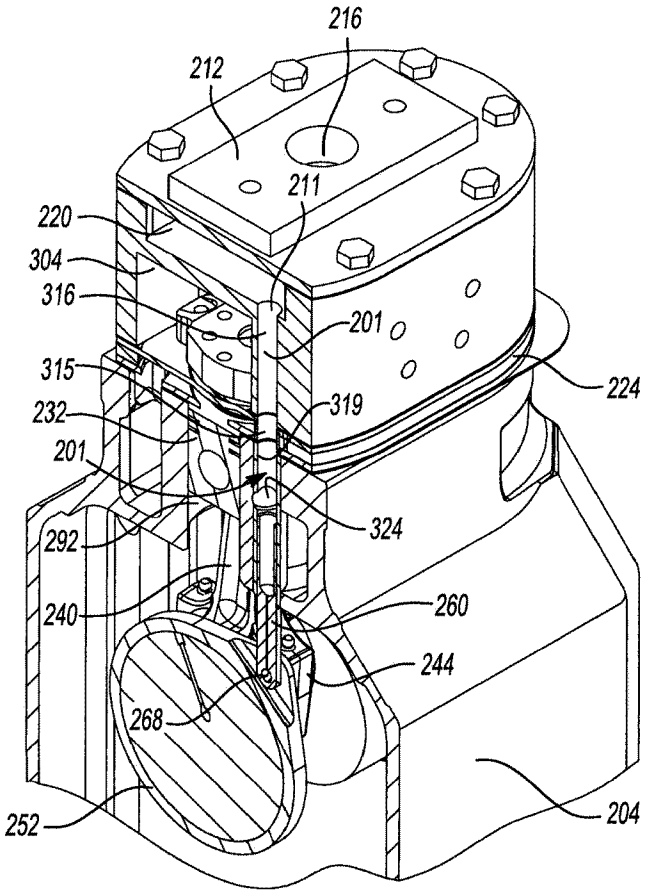
FIG. 9B is a perspective, cross-sectional view of the compressor of FIG. 7 taken along line 9B-9B and showing one of a pair of fluid-injection ports in an open state.
Figure 9A:
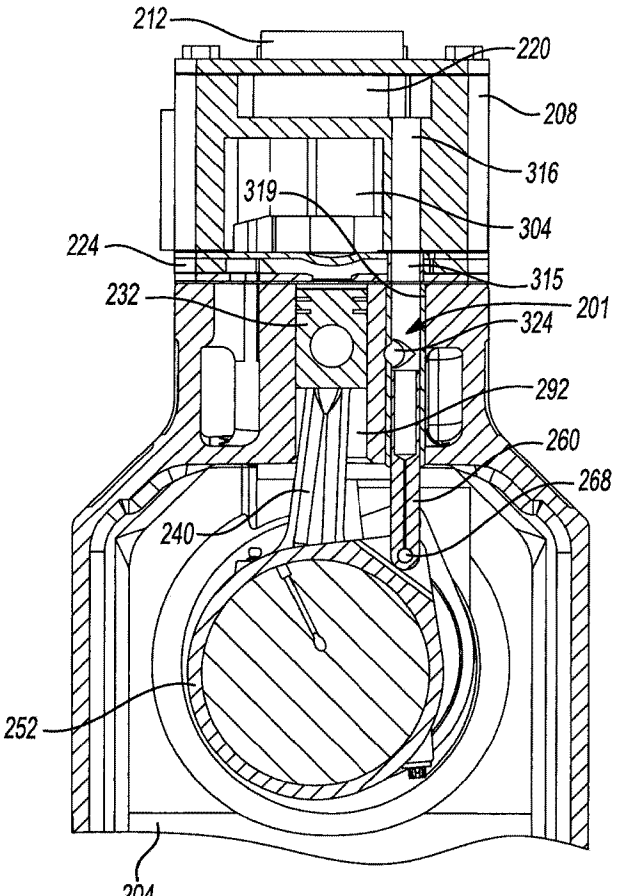
FIG. 9A is cross-sectional view of the compressor of FIG. 7 taken along line 9A-9A and showing one of a pair of fluid-injection ports in an open state.
Figure 10:
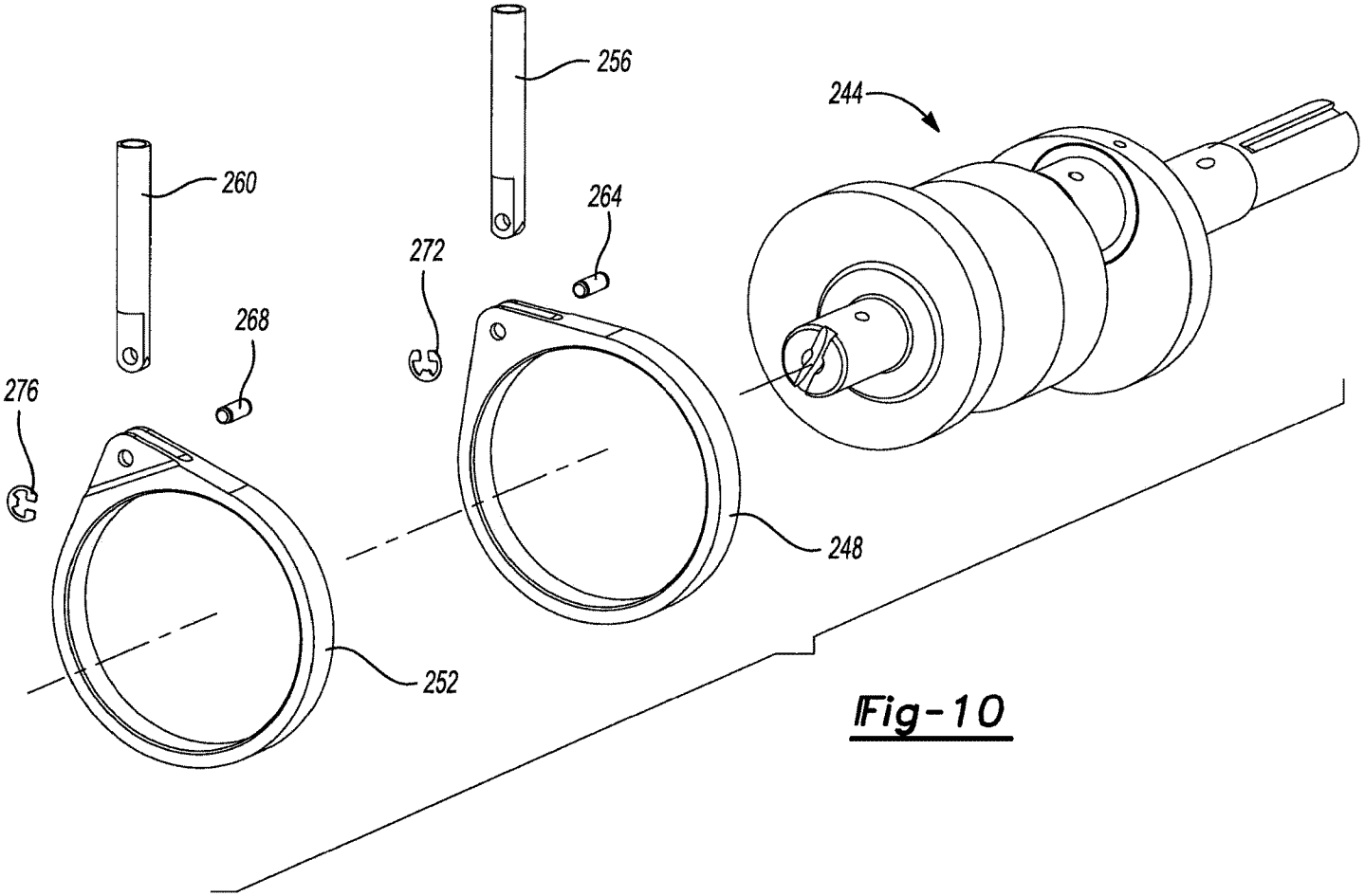
FIG. 10 is an exploded view of a crankshaft of the compressor of FIG. 7.

With additional reference to FIGS. 5-6, the passageways 141, 143 may each include gas-inlet ports 150, 154 that are in communication with the cylinders 106, 110. The inlet ports 150, 154 allow intermediate-pressure vapor disposed within the passageways 141, 143 to flow into the cylinders 106, 110 to increase the pressure within the cylinders 106, 110, thereby reducing the work required to raise the pressure of the vapor within the cylinder 106, 110 to discharge pressure.

The flow of intermediate-pressure vapor from the passageways 141, 143 to the cylinders 106, 110 may be controlled by the pistons 82, 86. Specifically, one or both of the pistons 82, 86 may include a window or opening 158 disposed along a length thereof. The window 158 may be positioned relative to one of the gas-inlet ports 150, 154 to allow the intermediate-pressure vapor to enter one of the first and second cylinders 106, 110. Additionally, one of the ports 150, 154 may be positioned at a location along one of the passageways 131, 143 such that the particular port 150, 154 is disposed in close proximity to the valve plate 38. If the port 150, 154 is positioned in close proximity to the valve plate 38, the piston 82, 86 disposed within the passageway 141, 143 may not need a window 158 to allow selective communication between the port 150, 154 and one of the cylinders 106, 110.

For example, if the port 154 is formed in close proximity to the valve plate 38, the piston 86 can close the port 150 when the first end of the piston 86 is in close proximity to the valve plate 38 (FIG. 6) and can open the port 154 when the first end of the piston 86 is moved sufficiently away from the valve plate 38 such that the piston 86 no longer blocks the port 154 (FIG. 5). Movement of the piston 86 is controlled by the location of the follower 78 along the cam profile 70. Accordingly, the cam profile 70 may be configured to allow the port 154 to open at a predetermined time relative to a position of the piston 54 within the cylinder 110. For example, the cam profile 70 may be shaped such that the piston 86 allows flow of intermediate-pressure vapor into the cylinder 110 for approximately the first ninety degrees (90°) of the compression process (i.e., for approximately the first half of the time the piston 54 moves from the BDC position to the TDC position). For the remainder of the compression process and the entire suction stroke (i.e., when the piston 54 moves from the TDC position to the BDC position), the piston 86 blocks the inlet port 154, thereby restricting flow of intermediate-pressure vapor from the vapor storage plenum 34 to the cylinder 110.

In other examples, the piston 86 may open the port 154 anytime between fifty degrees (50°) before the piston 54 reaches BDC (during a suction stroke) and fifty degrees (50°) after the piston 54 reaches BDC (during a compression stroke). Meanwhile the piston 86 may close the port 154 anytime between fifty degrees (50°) after the piston 54 reaches BDC (during the compression stroke) and one hundred twenty degrees (120°) after the piston 54 reaches BDC. For various refrigerants, the opening and closing of the port 154 may be optimized. For example, R404A may prefer to open at around twenty degrees (20°) before the piston 54 reaches BDC and close at around ninety degrees (90°) after the piston 54 reaches BDC.

The first piston 82 may operate in a similar fashion. However, the first piston 82 may be configured to permit flow of intermediate-pressure vapor from the vapor-storage plenum 34 to the cylinder 106 via the window 158 when the window 158 is placed in fluid communication with the port 150 (FIG. 6) and may prevent such communication when the window 158 does not oppose the port 150 (FIG. 5). As with the piston 86, the relative position of the piston 82 within the passageway 131 is controlled by the position of the follower 74 along the cam profile 70. Accordingly, the cam profile 70 may be shaped such that the piston 82 allows flow of intermediate-pressure vapor into the cylinder 106 for approximately the first ninety degrees (90°) of the compression process (i.e., for approximately the first half of the time the piston 50 moves from the BDC position to the TDC position). For the remainder of the compression process and the entire suction stroke (i.e., when the piston 50 moves from the TDC position to the BDC position), the first piston 82 blocks the inlet port 150, thereby restricting flow of intermediate-pressure vapor from the vapor storage plenum 34 to the cylinder 106.

While the piston 86 is described and shown as including a substantially uniform cross-section along a length thereof and the piston 82 is shown as including a window 158, either or both piston 82, 86 could be configured to have a uniform cross-section or a window 158. The configuration of the pistons 82, 86 and the location of the window 158 along the length of either or both pistons 82, 84 may be driven by the location of each port 150, 154 along the respective passageways 131, 143 as well as by the shape of the cam profile 70. Namely, each piston 82, 86 may include a substantially constant cross-section along a length thereof if the ports 150, 154 are positioned in sufficient proximity to the valve plate 38 and the shape of the cam profile 70 is such that the first ends of each piston 82, 86 may be sufficiently moved away from the ports 150, 154 (i.e., in a direction away from the valve plate 38) to selectively permit fluid communication between the passageways 134, 138 and the ports 150, 154 at a desired time relative to the compression cycle of each piston 50, 54.

While the vapor injection system 20 is described and shown as including a single cam profile 70, the crankshaft 66 could alternatively include separate cam profiles that separately control the pistons 82, 86. Such a configuration would allow the pistons 82, 86 to be substantially identical while concurrently opening and closing the respective ports 150, 154 at different times to accommodate the compression cycles of the respective pistons 50, 54.

With particular reference to FIGS. 7-10, a compressor assembly 200 is provided and may include a compressor housing 204 having a cylinder head 208. The cylinder head 208 may include a top plate 212 having an inlet port 216 and a vapor-storage plenum 220. The cylinder head 208 may be incorporated into the compressor body by a valve plate 224.

First and second pistons 228, 232 may be located within the compressor housing 204 and may be reciprocally movable in linear directions by respective connecting rods 236, 240. The connecting rods 236, 240 are disposed between the respective pistons 228, 232 and a crankshaft 244. While the compressor assembly 200 will be described and shown hereinafter as including two pistons 228, 232, the compressor assembly 200 may include fewer or more pistons.

The crankshaft 244 may include a first and second eccentric profile 248, 252 for controlling first and second rods 256, 260. The first and second rods 256, 260 may be driven by the crankshaft 244 and may be rotatably connected to first and second pistons 256, 260. The first and second rods 256, 260 may each include a pin 264, 268 and clamp 272, 276 (FIG. 10) that cooperate to attach the respective rods 256, 260 to one of the eccentric profiles 248, 252. Attachment of each rod 256, 260 to the respective eccentric profiles 248, 252 allows the rotational force of the crankshaft 244 to be imparted on each rod 256, 260, thereby allowing each rod 256, 260 to translate relative to and within the compressor housing 204.

In operation, refrigerant is compressed in the reciprocating compressor assembly 200 from a suction pressure to a desired discharge pressure. Suction-pressure refrigerant initially passes through a suction-inlet port 280 of an end cap 284 of the compressor housing 204. The refrigerant is drawn into the compressor housing 204 at the inlet port 280 due to the reciprocating motion of each piston 228, 232 within and relative to each cylinder 288, 292. As with the compressor assembly 10, the compressor assembly 200 is a so-called "low-side" compressor assembly, as the compressor housing 204 is at suction pressure. Accordingly, operation of the pistons 228, 232 draws suction-pressure vapor from the compressor housing 204 and into each cylinder 288, 292 which, in turn, cause more suction-pressure vapor to be drawn into the compressor housing 204. Once the refrigerant is disposed within each cylinder 288, 292, the first and second pistons 228, 232 cooperate with the crankshaft 244 to compress the refrigerant from suction pressure to discharge pressure in a similar fashion as described above with respect to the compressor assembly 10.

Namely, refrigerant enters the first and second cylinders 288, 292 during a suction stroke of each piston 228, 232 when the piston 228, 232 is moving from a top dead center (TDC) position to a bottom dead center (BDC) position. When the piston 228, 232 is at the TDC position, the crankshaft 244 must rotate approximately one-hundred and eighty degrees (180°) to move the particular piston 228, 232 into the BDC position, thereby causing the piston 228, 232 to move from a location proximate to a top portion of the particular cylinder 288, 292 to a bottom portion of the cylinder 288, 292. When the pistons 228, 232 are moved into the BDC position from the TDC position, the particular cylinder 288, 292 is placed under a vacuum, which causes suction-pressure vapor to be drawn into the cylinder 288, 292.

The first and second pistons 228, 232 move linearly in alternating directions as the crankshaft 244 is driven by an electric motor (not shown). As the crankshaft 244 rotates, the piston 228, 232 is driven in an upward direction, compressing refrigerant disposed within the cylinder 288, 292. When the pistons 228, 232 travel to the TDC position, the effective volume of the cylinder 288, 292 is reduced, thereby compressing the refrigerant disposed within the cylinder 288, 292. The compressed refrigerant remains in the gaseous state but is elevated from suction pressure to discharge pressure.

Following compression, the piston 228, 232 returns to BDC and refrigerant is once again drawn into the cylinder 288, 292. While the first and second pistons 228, 232 are concurrently driven by the crankshaft 244, the first and second pistons 228, 232 are out-of-phase with one another. Namely, when one of the pistons 228, 232 is in the TDC position, the other of the pistons 228, 232 is in the BDC position. Further, when one of the pistons 228, 232 is moving from the BDC position to the TDC position, the other of the pistons 228, 232 is moving from the TDC position to the BDC position. Accordingly, for a compressor assembly 200 having a pair of pistons 228, 232, one of the pistons 228, 232 is drawing gaseous refrigerant into one of the cylinders 288, 292 during operation of the compressor assembly 200 while the other of the pistons 228, 232 is compressing refrigerant in the other of the cylinders 288, 292.

The refrigerant may be expelled from the housing 204 through the discharge port 308 in the compressor housing 204 once the refrigerant reaches discharge pressure. The discharge-pressure refrigerant remains in the vapor state and may be communicated to a heat exchanger of an external refrigeration system (neither shown). For example, the discharge-pressure refrigerant may be communicated to a condenser (not shown) of a refrigeration system to allow the refrigerant to release heat and change phase from a vapor to a liquid, thereby providing a heating or cooling effect to a conditioned space.

With continued reference to FIGS. 7-10, the compressor assembly 200 is shown as including an economized vapor-injection system 201 that improves compressor performance and efficiency. The vapor injection system 201 may selectively inject intermediate-pressure vapor into the compressor assembly 200 to reduce the work required by the compressor assembly 200 to elevate a pressure of the vapor to discharge pressure. As a result, the energy consumed by the compressor assembly 200 in generating discharge-pressure vapor can be reduced, thereby resulting in an increase in both compressor capacity and efficiency.

The vapor injection system 201 may receive intermediate-pressure vapor from an external heat exchanger such as a flash tank or economizer heat exchanger (neither shown) and may selectively supply the intermediate-pressure vapor to the compressor housing 204 via the cylinder head 208 and the inlet port 216 formed in the top plate 212. The intermediate-pressure vapor may be stored in the vapor-storage plenum 220 until the intermediate-pressure vapor is needed during the compression cycle.

The cylinder head 208 and the compressor housing 204 may cooperate to provide a fluid path extending between the vapor-storage plenum 220 and the cylinders 288, 292. The fluid path may include a pair of ports 209 (FIG. 8B), 211 (FIG. 9B) that are formed in the cylinder head 208 and are in communication with fluid passageways 312, 316 formed through the cylinder head 208. The passageways 312, 316 may extend through the cylinder head 208 such that each port 209, 211 is in fluid communication with ports 313 (FIG. 8A), 315 (FIG. 9A) formed in the valve plate 224 (FIGS. 8A-9B) via the passageways (312, 316).

As shown in the FIGS. 8A-9B, the ports 313, 315 are disposed in close proximity to the compressor housing 204 to allow intermediate-pressure vapor disposed within each passageway 312, 316 to freely flow from the passageways 312, 316 and into the compressor housing 204 via the ports 313, 315.

The intermediate-pressure vapor is permitted to freely enter a pair of fluid passageways 317, 319 formed in the compressor housing 204 but is restricted from freely flowing into the cylinders 288, 292 by the first and second rods 256, 260. Accordingly, the first and second rods 256, 260 control the flow of intermediate-pressure vapor from the passageways 317, 319 and into the first and second cylinders 288, 292.

With particular reference to FIGS. 8A-9B, operation of the vapor-injection system 201 will be described in detail. Rotation of the crankshaft 244 likewise causes rotation of the first and second eccentric profiles 248, 252 relative to the compressor housing 204. The first and second eccentric profiles 248, 252 are shaped such that as the first and second eccentric profiles 248, 252 rotate, the first and second rods 256, 260 move linearly, alternating in direction. As the first and second rods 256, 260 rise and fall in relation to the first and second eccentric profiles 248, 252, the first and second rods 256, 260 open and close first and second gas-inlet ports 320, 324 to allow the intermediate-pressure vapor to enter the first and second cylinders 288, 292. The first and second eccentric profiles 248, 252 are shaped to allow gas flow into each cylinder 288, 292 for a predetermined time during the compression stroke (i.e., approximately the first half of piston travel from BDC to TDC). For the remainder of the compression stroke and the entire suction stroke, the first and second rods 256, 260 block the first and second gas-inlet ports 320, 324 to prevent the flow of intermediate-pressure vapor into the cylinders 288, 292.

The first and second rods 256, 260 may be attached at specific locations around a perimeter of the first and second eccentric profiles 248, 252 to control injection of intermediate-pressure vapor into the first and second cylinders 288, 292. For example, the first rod 256 may expose the first gas-inlet port 320 to allow gas flow into the first cylinder 288 (FIGS. 8A-8B) for the first half of piston travel from BDC to TDC (i.e., the first ninety degrees (90°) of rotation of the crankshaft 244 during the compression cycle). After the predetermined amount of time during the compression cycle, the first rod 256 rises to block the port 320 for the remainder of the compression cycle to prevent intermediate-pressure vapor from entering the cylinder 288.

The second rod 260 may block the second gas-inlet port 324 when the first gas-inlet port 320 is open. Conversely, the second rod 260 may retract and open the second gas-inlet port 324 when the first gas-inlet port 320 is closed. In short, the first rod 256 and the second rod 260 are out-of-phase with one another and, as a result, do not permit both ports 320, 324 to be open at the same time.

The first rod 256 and the second rod 260 may cooperate with the first and second eccentric profiles 248, 252, respectively, to open the ports 320, 324 at different times to accommodate compression timing in each cylinder 288, 292. Namely, the first rod 256 and second rod 260 may be poisoned in a lowered state to respectively open the ports 320, 324 at different times such that the ports 320, 324 are open for the first half of piston travel from BDC to TDC (i.e., the first ninety degrees (90°) of rotation of the crankshaft 244 during the compression cycle) for each piston 228, 232.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A compressor assembly comprising:

a first compression cylinder;

a first compression piston disposed within said first compression cylinder and operable to compress a vapor disposed within said first compression cylinder;

a crankshaft operable to cycle said first compression piston within said first compression cylinder;

a second compression cylinder;

a second compression piston disposed within said second compression cylinder and operable to compress vapor disposed within said second compression cylinder;

a first control piston moveable between a first state restricting passage of intermediate-pressure fluid into said first compression cylinder and a second state permitting passage of intermediate-pressure fluid into said first compression cylinder;

a second control piston moveable between a first state restricting passage of intermediate-pressure fluid into said second compression cylinder and a second state permitting passage of intermediate-pressure fluid into said second compression cylinder; and a first gas-inlet port in fluid communication with said first compression cylinder and extending through a cylindrical wall of the first compression cylinder, wherein said first control piston blocks said first gas-inlet port in said first state preventing fluid flow from entering said first gas-inlet port in said first state and opens said first gas-inlet port in said second state allowing fluid flow through said first gas-inlet port in said second state, wherein, in said first state, said first control piston prevents fluid from being discharged from said first compression cylinder through any portion of said first gas-inlet port, wherein said first control piston and said second control piston are moved between said first state and said second state by said crankshaft, wherein the first control piston includes a window through which intermediate-pressure fluid flows into said first compression cylinder when the first control piston is in the second state, wherein said first control piston prevents communication between the window and the first compression cylinder when the first control piston is in the first state, and wherein the second control piston does not include a window through which intermediate-pressure fluid flows into said second compression cylinder when the second control piston is in the second state.

2. The compressor assembly of claim 1, wherein said crankshaft includes a cam profile operable to move said first and second control pistons between said first state and said second state.

3. The compressor assembly of claim 2, wherein said first and second control pistons are biased into engagement with said cam profile.

4. The compressor assembly of claim 2, wherein said first and second control pistons are biased into engagement with said cam profile by said intermediate-pressure fluid.

5. The compressor assembly of claim 2, wherein said first and second control pistons are biased into engagement with said cam profile by a biasing element.

6. The compressor assembly of claim 1, wherein said second control piston includes a first end in contact with said crankshaft and a second end in fluid communication with said intermediate-pressure fluid, said second end exposing a second gas-inlet port when said second control piston is in said second state to permit said intermediate-pressure fluid to enter said second compression cylinder via said second gas-inlet port.

7. The compressor assembly of claim 1, wherein movement of said first control piston and said second control piston between said first state and said second state is controlled by said crankshaft.

8. The compressor assembly of claim 7, wherein said crankshaft includes a cam profile that controls movement of said first control piston and said second control piston.

9. The compressor assembly of claim 7, wherein said crankshaft includes a first portion operable to move said first control piston between said first state and said second state and a second portion operable to move said second control piston between said first state and said second state.

10. The compressor assembly of claim 9, wherein said first portion is spaced apart from said second portion in a direction extending along a length of said crankshaft.

11. The compressor assembly of claim 1, wherein said first control piston and said second control piston are moved into said first state and into said second state at different times.

12. The compressor assembly of claim 11, wherein movement of said first control piston and said second control piston between said first state and said second state is controlled by said crankshaft.

13. The compressor assembly of claim 1, wherein the first gas-inlet port opens into the first compression cylinder at a location that is axially between a bottom dead center position of the first compression piston and a top dead center position of the first compression piston.

14. The compressor assembly of claim 1, wherein an end of each of the first and second control pistons includes a lubricant drain passage disposed adjacent said crankshaft.

15. A compressor assembly comprising:

a first compression cylinder;

a first compression piston disposed within said first compression cylinder and operable to compress a vapor disposed within said first compression cylinder;

a crankshaft operable to cycle said first compression piston within said first compression cylinder;

a second compression cylinder;

a second compression piston disposed within said second compression cylinder and operable to compress vapor disposed within said second compression cylinder;

a first control piston moveable between a first state restricting passage of intermediate-pressure fluid into said first compression cylinder and a second state permitting passage of intermediate-pressure fluid into said first compression cylinder; and a second control piston moveable between a first state restricting passage of intermediate-pressure fluid into said second compression cylinder and a second state permitting passage of intermediate-pressure fluid into said second compression cylinder, wherein the first control piston includes a window through which intermediate-pressure fluid flows into said first compression cylinder when the first control piston is in the second state, wherein said first control piston prevents communication between the window and the first compression cylinder when the first control piston is in the first state, and wherein the second control piston does not include a window through which intermediate-pressure fluid flows into said second compression cylinder when the second control piston is in the second state.

16. The compressor assembly of claim 15, wherein said first control piston and said second control piston are moved between said first state and said second state by said crankshaft, and wherein an end of each of the first and second control pistons includes a lubricant drain passage disposed adjacent said crankshaft.

17. The compressor assembly of claim 15, further comprising:

a first port in fluid communication with said first compression cylinder; and a second port in fluid communication with said second compression cylinder.

18. The compressor assembly of claim 17, wherein said first control piston blocks said first port in said first state, and wherein said window is aligned with said first port when said first control piston is in said second state.

* * * * *